US006608289B2

(12) United States Patent
Tsuruya

(10) Patent No.: US 6,608,289 B2
(45) Date of Patent: Aug. 19, 2003

(54) HEATING APPARATUS AND IMAGE FORMING APPARATUS

(75) Inventor: Takaaki Tsuruya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/061,158

(22) Filed: Feb. 4, 2002

(65) Prior Publication Data

US 2002/0108947 A1 Aug. 15, 2002

(30) Foreign Application Priority Data

Feb. 6, 2001 (JP) ..... 2001/029618

(51) Int. Cl.[7] ..... H05B 6/06; H05B 6/14

(52) U.S. Cl. ..... 219/619; 219/661; 399/328; 399/330; 399/335

(58) Field of Search ..... 219/619, 661, 219/665, 663, 667; 399/328, 330, 331, 335, 67, 69

(56) References Cited

U.S. PATENT DOCUMENTS 5,899,610 A 5/1999 Enomoto et al. ..... 399/302
6,037,576 A * 3/2000 Okabayashi et al. ..... 219/619
6,088,567 A 7/2000 Miyashiro et al. ..... 399/400
6,097,006 A * 8/2000 Inukai ..... 399/69

FOREIGN PATENT DOCUMENTS

JP 2-105189 * 4/1990 ..... 399/325

* cited by examiner

*Primary Examiner*—Philip H. Leung
(74) *Attorney, Agent, or Firm*—Fitzpatrick, Cella, Harper & Scinto

(57) ABSTRACT

There is disclosed a heating apparatus of a magnetic induction heating system. This heating apparatus comprises a control mode for a power source (excitation circuit) for supplying power to magnetic field generating means (exciting coil). The control mode includes a first mode for controlling an ON width by fixing the number of ON times per unit time of a switching element of an inverter circuit of a voltage resonance system when power larger than a predetermined value is supplied, and a second mode for controlling the number of ON times per unit time by fixing the ON width of the switching element to a predetermined ON width.

20 Claims, 11 Drawing Sheets

HEATING APPARATUS AND IMAGE FORMING APPARATUS

BACKGROUND OF THE INVENTION

1. Field of the Invention

The present invention relates to a heating apparatus of a magnetic (electromagnetic) induction heating system. The present invention also relates to an image forming apparatus comprising the heating apparatus as heat fixing means of an unfixed toner image.

2. Description of the Related Art

For convenience, description is made by taking an example of a fixing apparatus as a heating apparatus for fixing an unfixed toner image on a recording material, which is provided in an image forming apparatus such as a copying machine or a printer.

In such an image forming apparatus, an apparatus of a heat roller system has widely been used as a fixing apparatus for fixing an unfixed toner image of target image information on a surface of a recording material by heating as a permanently fixed image, the unfixed toner image of the target image information having been formed and born on the recording material (transferring material sheet, electrofax sheet, electrostatic recording sheet, OHP sheet, printing sheet, formatting sheet or the like) by proper image forming process means portion such as an electrophotographic process, an electrostatic recording process, or a magnetic recording process based on a transferring system or a direct system.

In recent years, an apparatus of a belt heating system has been put to practical use in order to achieve a quick start and energy conservation and, as a much more efficient fixing apparatus, a fixing apparatus of a magnetic induction heating system has been presented. This fixing apparatus is adapted to apply a magnetic field of magnetic field generating means for generating a magnetic field (high-frequency magnetic field) by receiving supply of power to a magnetic induction heat generating heating member (conductive member) to be fixed or moved, and heat a target material by heat (eddy current loss, or Joule heat) generated by an induced eddy current generated in the heating member. A promising heating member is an induction heating system for causing a belt (film) to generate heat itself.

In the magnetic induction heating system, an inverter circuit is used for a power source (excitation circuit, or high-frequency power source) provided to supply power to an exciting coil of the magnetic field generating means, and there are generally current and voltage resonance systems. The resonance system actively generates a vibration state of a voltage or a current generated during switching, and executes switching to a switching element by choosing a time when a value of the voltage or current, or values of both are lowest, in order to reduce a loss of the switching element for conversion when relatively large power is used. This resonance system also called soft switching is a most effective method when large power is used. Especially, the voltage resonance system has been a mainstream system for an induction heating power source, because it can be provided by a simple configuration.

FIG. 13 shows an inverter circuit of such a voltage resonance system. In the drawing, a reference numeral 271*a* denotes a switching element such as an IGBT; 271*b* a resonance coil (exciting coil); 271*c* a resonance capacitor; and 271*d* a regenerative diode.

In an operation of the voltage resonance inverter circuit, when the switching element 271*a* is turned ON to store power in the resonance coil 271*b*, and then turned OFF, a voltage starts vibrating in an arc of resonance at a cycle decided by constants of the resonance coil 271*b* and the resonance capacitor 271*c*.

A state in the above case is shown in FIG. 14, where a reference numeral 271S denotes a gate switching signal entered to the switching element 271*a*; 271V a voltage applied to the switching element 271*a*; and 271I a current flowing to the switching element 271*a*.

Power is represented by a product of a voltage and a current. It can be understood from the current 271I and the voltage 2171V that during an operation of the switching element 271*a*, there are no points of simultaneous application of a voltage and a current, thus generating no power loses.

A temperature of the fixing apparatus of the magnetic induction heating system based on the above voltage resonance system is controlled based on an ON width of the switching element 271*a*. That is, a power input is increased when an ON width is long, and reduced when an ON width is short.

FIG. 15 shows an operation waveform when a power conversion operation is performed by reducing an ON width of the gate switching signal 271S in order to make output power small. A voltage waveform of the switching element 271*a* when the output power is made small draws a sine wave resonance-damped with a power supply voltage (level indicated by broken line) terminal-connected to the resonance coil 271*b* set as a reference. Vibration amplitude of a voltage depends on exciting power stored in the resonance coil 271*b*, i.e., an ON width of the switching element 271*a*. This vibration amplitude is small during power saving, and the voltage is not sufficiently lowered from the power supply voltage, making it impossible to obtain zero crossing.

Thus, when the switching element 271*a* is operated, a current flows always in a voltage applied state, causing a power loss in the switching element 271*a*. The switching element 271*a* is driven for switching on an order of $\mu$s. If a power loss occurs for each driving, heat generated by the loss becomes very large, creating a possibility that even the switching element 271*a* itself will be broken.

During continuous printing, when the fixing apparatus is set in a sufficiently heated state, input power must be reduced to about 100 W. However, the input power can only be reduced to about 300 to 400 W if a minimum ON width is set to prevent heat destruction of the switching element 271*a*. That is, in the conventional fixing apparatus of the electromagnetic induction heating system based on the voltage resonance system, there is inherent a problem that a temperature of the fixing apparatus becomes equal to/higher than a set level during the continuous printing.

SUMMARY OF THE INVENTION

An object of the present invention is to enable saved power to be inputted in a heating apparatus of a magnetic induction heating system. Another object is to enable continuous printing to be satisfactorily performed even when a magnetic induction heating system is employed for a heating apparatus (fixing apparatus) of an image forming apparatus.

In order to achieve the foregoing object, in accordance with the present invention, there is provided a heating apparatus of a magnetic induction heating system, comprising: power control for executing variable control from minimum power, not zero, to maximum power in an ON state; and power control for executing control of repetition of the power control between ON and OFF states.

In order to achieve the foregoing object, in accordance with the present invention, there is provided an image forming apparatus comprising: image forming means for forming an bearing an unfixed toner image on a recording material; and fixing means for fixing the unfixed toner image on the recording material by heat. In this case, the fixing means includes power control for executing variable control from minimum power, not zero, to maximum power on an ON state, and power control for executing repetition of the power control between ON and OFF states.

Preferably, when the control for the repetition between the ON and OFF states is carried out, power inputted on the ON state is minimum power to be inputted by the variable control.

According to the present invention, in the heating apparatus of the magnetic induction heating system, by using both ON width control of a switching element of an inverter circuit of a voltage resonance system, and ON-OFF control as a control mode for a power source (excitation circuit) for supplying power to magnetic field generating means (exciting coil), saved power input can be realized in the apparatus. That is, in a normal state, power is controlled by the ON width control of the switching element of the inverter circuit and, when power of a minimum ON width or lower is controlled, control can be executed from small power to large power by fixing the ON width of the switching element to the minimum ON width, and executing ON-OFF repetition control. Thus, continuous printing can be performed satisfactorily even when the magnetic induction system is employed for the heating apparatus of the image forming apparatus.

These and other objects, features, and advantages of the present invention will become more apparent upon consideration of the following description of the preferred embodiments of the present invention taken in conjunction with the accompanying drawings.

DESCRIPTION OF THE PREFERRED EMBODIMENTS

Next, detailed description will be made of the preferred embodiments of the present invention with reference to the accompanying drawings.

(First Embodiment)

(1) Example of Image Forming Apparatus

Figure 1:
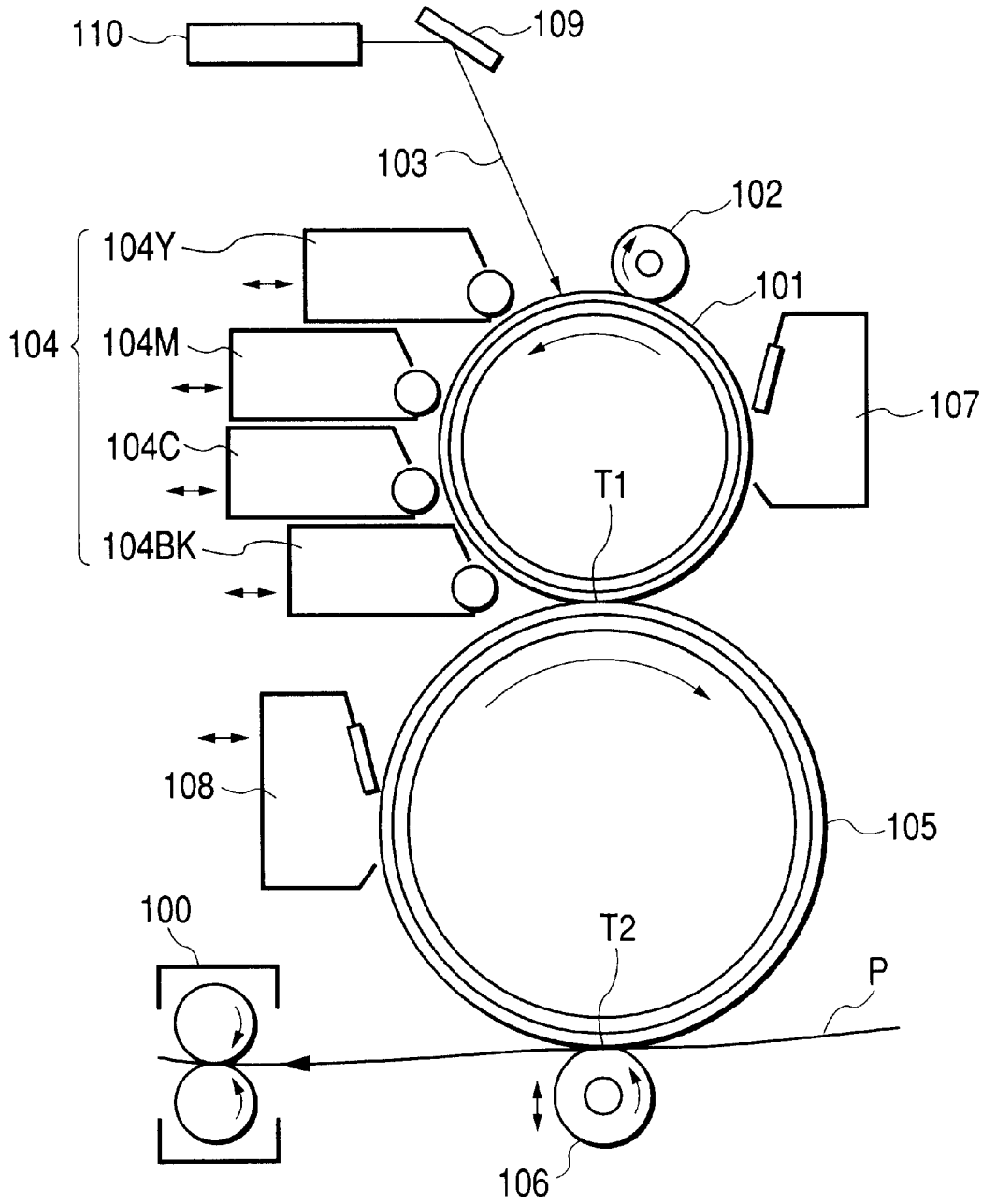
FIG. 1 is a schematic configuration view of an image forming apparatus used in a first embodiment of the present invention.

FIG. 1 is a schematic configuration view showing an example of an image forming apparatus. The image forming apparatus of the example is an electrophotographic color printer.

In the drawing, a reference numeral 101 denotes a photosensitive drum (image bearing body) made of an organic photosensitive body or an amorphous silicon photosensitive body, and rotary-driven in a counter clockwise direction indicated by an arrow at a predetermined processing speed (circumferential speed).

In its rotating process, the photosensitive drum 101 is subjected to uniform charging of a predetermined polarity/potential by a charging apparatus 102 such as a charging roller.

Then, the charged surface is subjected to scanning and exposing of image information by a laser beam 103 emitted from a laser optical box (laser scanner) 110. The laser optical box 110 emits the laser beam 103 modulated (ON/OFF) corresponding to a time series electric digital pixel signal of image information from an image signal generating apparatus such as an image reading apparatus, not shown, and then an electrostatic latent image corresponding to the scanned and exposed image information is formed on the surface of the rotary photosensitive drum 101. A reference numeral 109 denotes a mirror for deflecting the laser beam emitted from the laser optical box 110 to an exposing position of the photosensitive drum 101.

In the case of full color image formation, scanning and exposing latent image forming is carried out for a first color separation component image of a target full color image, e.g., a yellow component image, and the latent image is developed as a yellow toner image by an operation of a yellow developing device 104Y included in a 4-color developing apparatus 104. The yellow toner image is transferred to a surface of an intermediate transfer drum 105 in a primary transferring portion T1 as a contact portion (or proximate portion) between the photosensitive drum 101 and the intermediate transfer drum 105.

After the transfer of the toner image to the surface of the intermediate transfer drum 105, the surface of the rotary photosensitive drum 101 is subjected to cleaning carried out by removing stuck residues such as transfer residual toner by a cleaner 107.

A process cycle comprising the foregoing steps of charging, scanning and exposing, developing, primary transferring, and cleaning is executed sequentially for the following color separation component images of the target full color image: a second color separation component image (e.g., magenta component image, a magenta developing device 104M is operated), a third color separation component image (e.g., cyan component image, a cyan developing device 104C is operated), and a fourth color separation component image (e.g., black component image, a black developing device 104BK is operated). Totally four toner images, i.e., yellow, magenta, cyan and black toner images, are sequentially transferred to the surface of the intermediate transfer drum 105 in a superposed manner. As a result, a color toner image corresponding to the target full color image is formed by synthesis.

The intermediate transfer drum 105 includes an elastic layer of medium resistance, and a surface layer of high resistance on a metal drum. This intermediate transfer drum 105 is rotary-driven in a clockwise direction indicated by an arrow in contact with/in proximate relation to the photosensitive drum 101 at a circumferential speed roughly equal to that of the photosensitive drum 101. By applying a bias potential to the metal drum of the intermediate transfer drum 105, a toner image of the photosensitive drum 101 side is transferred to the surface side of the intermediate transfer drum 105 based on a potential difference with the photosensitive drum 101.

Then, in a secondary transferring portion T2 as a contact nip portion between the rotary intermediate transfer drum 105 and a transferring roller 106, the color toner image formed by synthesis on the surface of the rotary intermediate transfer drum 105 is transferred to a surface of a recording material P as material to be heated, which was fed into the secondary transferring portion T1 from a not-shown sheet feeding portion by a predetermined timing. By supplying charges of a polarity reverse to that of toner from a backside of the recording material P, the transferring roller 106 sequentially transfers the images constituting the synthesized color toner image en block from the surface side of the intermediate transfer drum 105 to the recording material P side.

The recording material P passed through the secondary transferring portion T2 is separated from the surface of the intermediate transfer drum 105, introduced to a heating apparatus 100, subjected to heating and fixing of an unfixed toner image, and then discharged as a color image formed material to a not-shown sheet discharging tray outside the apparatus. The heating apparatus 100 will be described later in detail in a next section (2).

After the transfer of the color toner image to the recording material P, the rotary intermediate transfer drum 105 is subjected to cleaning carried out by a cleaner 108 to remove stuck residuals such as transfer residual toner/sheet powder. This cleaner 108 is normally held in non-contact with the intermediate transfer drum 105. In a secondary transfer executing process of a color toner image from the intermediate transfer drum 105 to the recording material P, the cleaner 108 is held in contact with the intermediate transfer drum 105.

The image forming apparatus of the described example can also execute a printing mode of a monochromatic image such as a black and white image. In addition, the image forming apparatus can execute a double-sided image printing mode or a multiple image printing mode.

In the case of the double-sided image printing mode, a recording material P having an image printed on its first surface, which was put out of the heating apparatus 100, is subjected to reversal of front and rear surfaces, and fed again into the secondary transferring portion T2 by a not-shown recirculation conveying mechanism. The recording material P receives a toner image transfer on its second surface, and is fed again into the heating apparatus 100 to have the transferred toner image fixed on the second surface. As a result, a double-sided image print is outputted.

In the case of the multiple image printing mode, a recording material P having a first image printed, which was put out of the heating apparatus 100, is fed again into the secondary transferring portion T2 by the not-shown recirculation conveying mechanism without being reversed front and rear. The recording material P receives a second toner imager transfer on a surface, the first image having been printed thereon, and is fed again into the heating apparatus 100 to have the transferred second toner image fixed on. As a result, a multiple image print is outputted.

(2) Heating Apparatus 100

Figure 2:
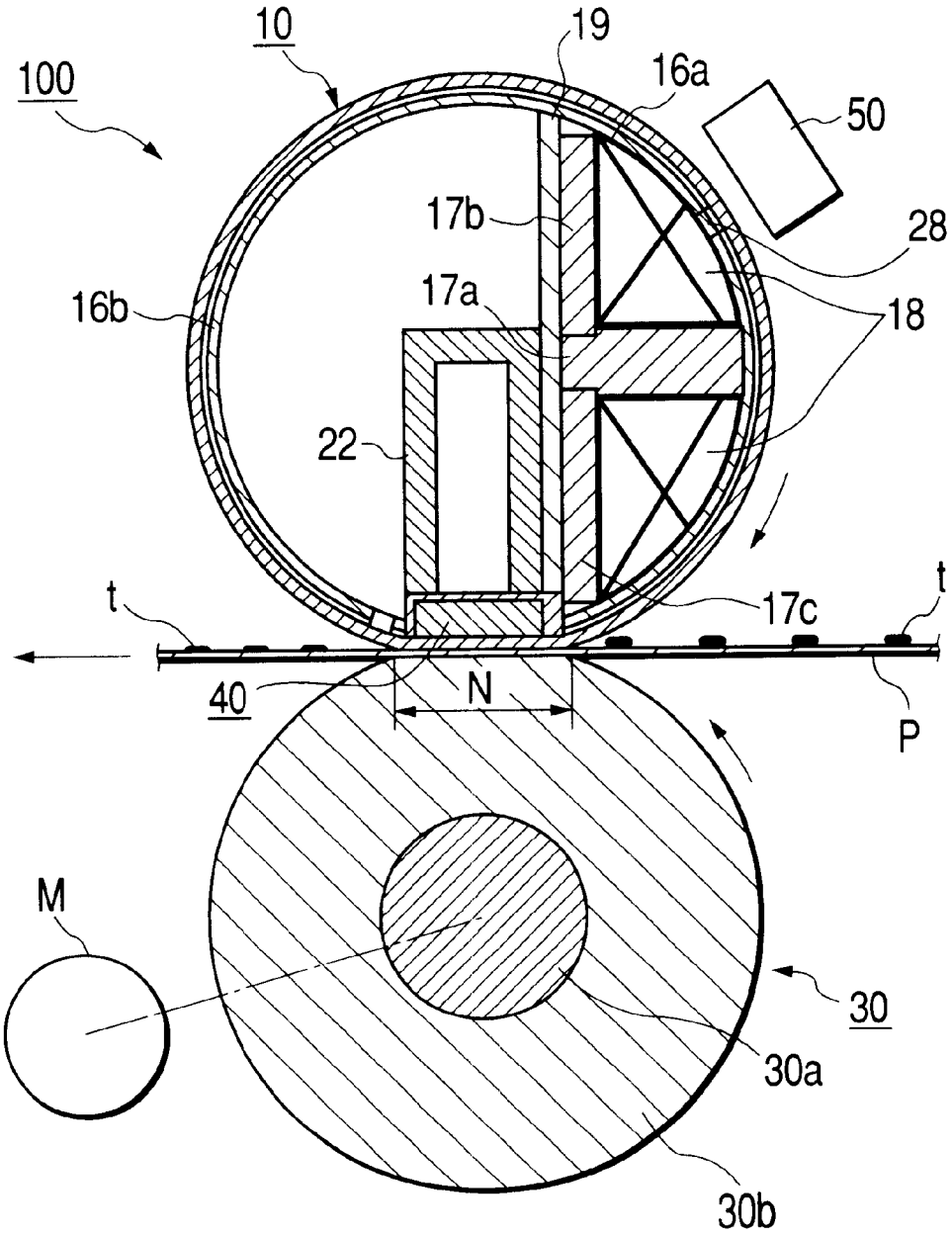
FIG. 2 is a schematic transverse side view showing main portions of a fixing apparatus as a heating apparatus.
Figure 3:
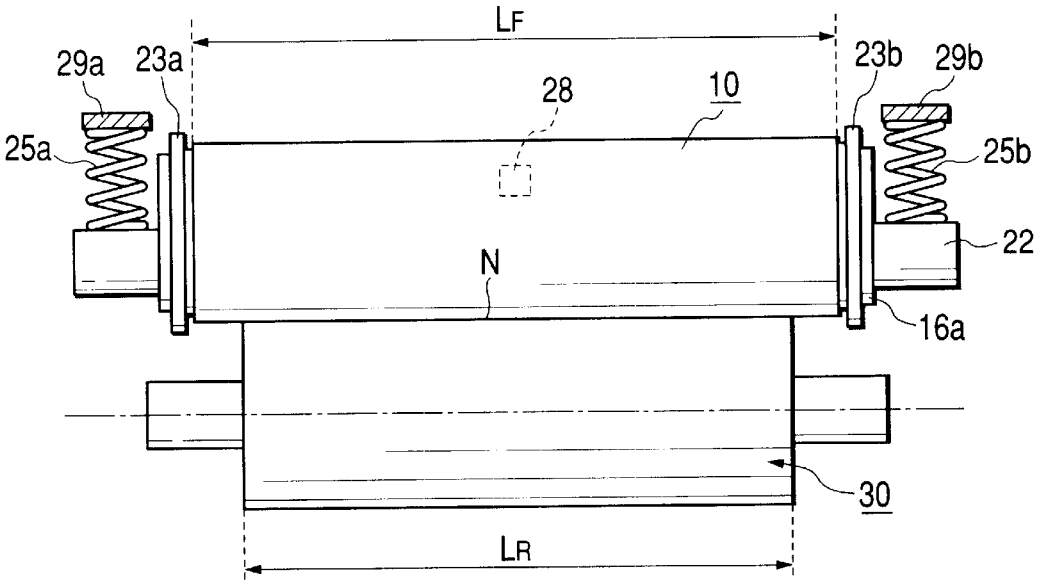
FIG. 3 is a schematic front view showing the same main portions.
Figure 4:
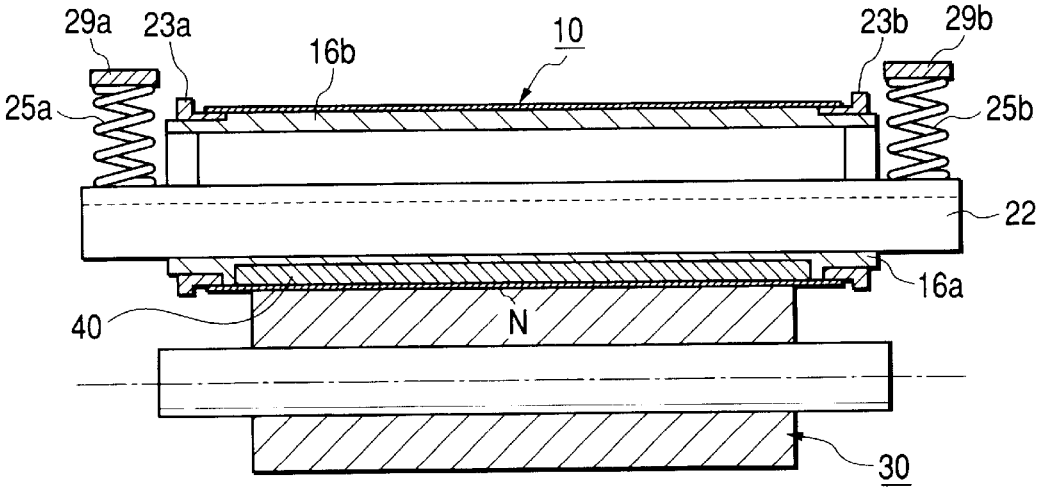
FIG. 4 is a schematic vertical front view showing the same main portions.

In the described example, the heating apparatus 100 is based on an electromagnetic induction heating system. FIG. 2 is a schematic transverse side view showing main portions of the heating apparatus of the example; FIG. 3 a schematic front view of the same; and FIG. 4 a schematic vertical front view of the same.

Magnetic field generating means is composed of magnetic cores 17*a* to 17*c*, and an exciting coil 18.

The magnetic cores 17*a* to 17*c* are members of high magnetic permeability, and a recommended material is ferrite, permalloy or the like, which is used for a core of a transformer. More preferably, ferrite having only a limited loss even at 100 kHz or higher should be used.

An excitation circuit 27 as a power source is connected to power supplying portions 18*a* and 18*b* (FIG. 5) of the exciting coil 18. This excitation circuit 27 can generate power of a high frequency from 20 kHz to 500 kHz by a switching power source.

The exciting coil 18 generates an alternating magnetic flux by an alternating current (high-frequency current) supplied from the excitation circuit 27.

Reference numerals 16*a* and 16*b* denote belt guiding members formed in tub shapes roughly semicircular-arc in transverse sections, and opening sides thereof are placed oppositely to each other so as to form a rough cylindrical body. A fixing belt (fixing film) 10 as a cylindrical electromagnetic induction heat generating belt is loosely fitted in outer sides thereof.

The belt guiding member 16*a* holds, inside, the magnetic cores 17*a* to 17*c* and the exciting coil 18 constituting the magnetic field generating means.

In addition, the belt guiding member 16*a* includes a sliding member 40 disposed inside the fixing belt 10, in a surface side opposite a pressure roller 30 of a nip portion N.

A reference numeral 22 denotes a pressure rigid stay long sideways, which is disposed in abutment on an inner planar portion of the belt guiding member 16*b*.

A reference numeral 19 denotes an insulating member for achieving insulation between the magnetic cores 17*a* to 17*c* and the exciting coil 18, and the pressure rigid stay 22.

Flange members 23*a* and 23*b* are fitted around both left and right ends of an assembly of the belt guiding members 16*a* and 16*b*, and rotatably attached while fixing the left and right positions. The flange members 23*a* and 23*b* serve to receive ends of the fixing belt 10, and regulate a meandering (approaching) movement of the fixing belt along longitudinal sides of the belt guiding members.

The pressure roller 30 as a pressurizing member is composed of a core metal 30*a*, and a heat-resistant/elastic layer 30*b* made of silicon rubber, fluorine-containing rubber, fluororesin or the like, which is molded and coated around the core metal concentric-integrally. In addition, a fluororesin can be provided to form a not-shown releasing layer in an outermost layer. Both ends of the core metal 30*a* are rotatably held by bearings between chassis side sheet metals, not shown, of the apparatus.

By providing pressure springs 25*a* and 25*b* in compressed states between both ends of the pressure rigid stay 22 and spring bearing members 29*a* and 29*b* of the apparatus chassis side, a depressing force is applied to the pressure rigid stay 22. Accordingly, the sliding member 40 in the bottom surface of the belt guiding member 16*a* and the pressure roller 30 sandwich the fixing belt 10 to be pressed into contact with each other, thereby forming a fixing nip portion N having a predetermined width.

The pressure roller 30 is rotary-driven by driving means M in a counter clockwise direction indicated by an arrow. A frictional force generated between the pressure roller 30 and an outer surface of the fixing belt 10 by the rotary driving of the pressure roller 30 causes a rotating force to be applied to the fixing belt 10. Thus, the fixing belt 10 is rotated around the belt guiding members 16*a* and 16*b* at a circumferential speed substantially corresponding to a rotational circumferential speed of the pressure roller 30 in a clockwise direction indicated by an arrow, while sliding with its inner surface in tight contact with the bottom surface of the sliding member 40 in the fixing nip portion N.

In this case, in order to reduce a mutual sliding frictional force between the bottom surface of the sliding member 40 and the inner surface of the fixing belt 10 in the fixing nip portion N, lubricant such as heat-resistant grease can be provided between the bottom surface of the sliding member 40 and the inner surface of the fixing belt 10 in the fixing nip portion N.

Figure 5:
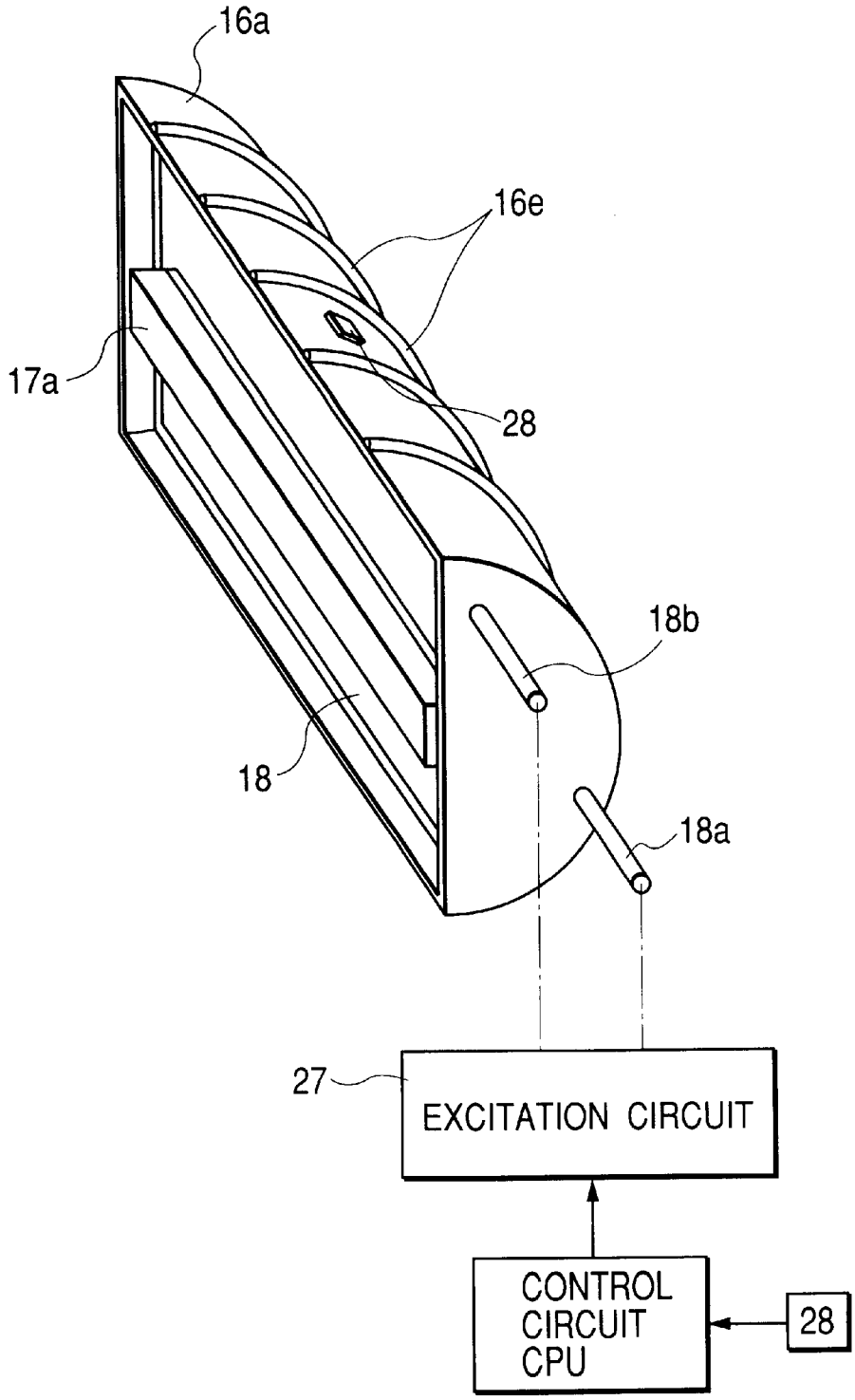
FIG. 5 is view showing a relation between magnetic field generating means and an excitation circuit.

In addition, as shown in FIG. 5, on a peripheral surface of the belt guiding member 16*a*, convex rib portions 16*e* are formed at predetermined intervals along a longitudinal direction thereof to reduce contact sliding resistance between the peripheral surface of the belt guiding member 16*a* and the inner surface of the fixing belt 10. Thus, a rotational load on the fixing belt 10 is reduced. Such convex rib portions can be similarly formed in the belt guiding member 16*b*.

Figure 6:
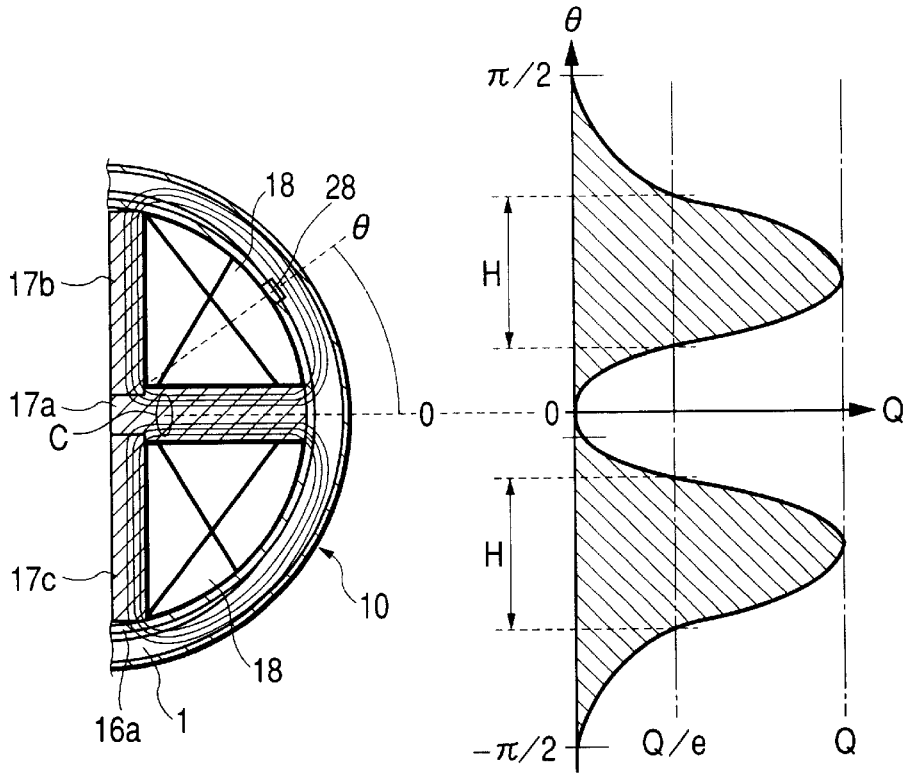
FIG. 6 is a view showing a relation between the magnetic field generating means and a quantity Q of generated heat.

FIG. 6 schematically shows a state of alternating magnetic flux generation. A magnetic flux C represents a part of a generated alternating magnetic flux.

The alternating magnetic flux C guided to the magnetic cores 17*a* to 17*c* generates eddy currents in an electromagnetic induction heat generating layer 1 of the fixing belt 10 between the magnetic cores 17*a* and 17*b*, and between the magnetic cores 17*a* and 17*c*. Such an eddy current generates Joule heat (eddy current loss) in the electromagnetic induction heat generating layer 1 by intrinsic resistance of the electromagnetic induction heat generating layer 1. In this case, a quantity of generated heat Q is decided by a density of a magnetic flux passed through the electromagnetic induction heat generating layer 1, exhibiting a distribution like that shown in a graph of FIG. 6. In the graph of FIG. 6, an ordinate indicates a position of a circumferential direction in the fixing belt 10, represented by an angle θ with a center of the magnetic core 17*a* set as 0; and an abscissa represents a quantity of generated heat Q in the electromagnetic induction heat generating layer 1 of the fixing belt 10. Here, if a maximum quantity of generated heat is Q, a heat generating region H is defined as a region where a quantity of generated heat is Q/e or higher. This is a region where a quantity of generated heat necessary for fixing can be obtained.

A temperature of the fixing belt 10, i.e., a temperature of the fixing nip portion N, is controlled such that a predetermined temperature can be maintained by using a temperature control system including temperature detecting means to control a current supplied to the exciting coil 18. That is, a reference numeral 28 denotes a temperature sensor such as a thermistor for detecting the temperature of the fixing belt 10. In the described example, the temperature sensor 28 is disposed in the heat generating region H in the inner surface of the fixing belt by being exposed to an outer surface of the belt guiding member 16*a*. This temperature sensor 28 is brought into contact with the inner surface of the fixing belt 10 to detect the temperature thereof. Information regarding the temperature of the fixing belt measured by the temperature sensor 28 is entered to a control circuit CPU (FIG. 5). The control circuit CPU controls the excitation circuit 27 based on the entered temperature information, and a current supplied to the exciting coil 18 to control the temperature of the fixing belt 10, i.e., the temperature of the fixing nip portion N, to a predetermined temperature.

Thus, a state is set, where the fixing belt 10 is rotated, power supplied from the excitation circuit 27 to the exciting coil 18 generates heat in the fixing belt 10 in an electromagnetic inductive manner, the fixing nip portion N is started at a predetermined temperature, and a temperature is controlled. In this state, the recording material P having an unfixed toner image t conveyed from the image forming means portion and formed thereon is introduced between the fixing belt 10 and the pressure roller 30 of the fixing nip portion N with an image surface up, i.e., oppositely to the fixing belt surface. In the fixing nip portion N, the image surface is brought into tight contact with the outer surface of the fixing belt 10, and the recording material P is sandwiched and conveyed integrally with the fixing belt 10. In this process of sandwiching and conveying the recording material P integrally with the fixing belt 10, the fixing nip portion N is heated by the electromagnetic induction heat generated in the fixing belt 10, and accordingly the unfixed toner image t on the recording material P is heated and fixed. After passing through the fixing nip portion N, the recording material P is separated from the outer surface of the fixing belt 10, discharged and conveyed. The heated and fixed toner image on the recording material is passed through the fixing nip portion, and then cooled to be a permanently fixed image.

In the example, as shown in FIG. 2, in a position opposite the heat generating region H (FIG. 6) of the fixing belt 10, a thermoswitch 50 is disposed to serve as a temperature detecting element for cutting off supply of power to the exciting coil 18 during runaway.

Figure 7:
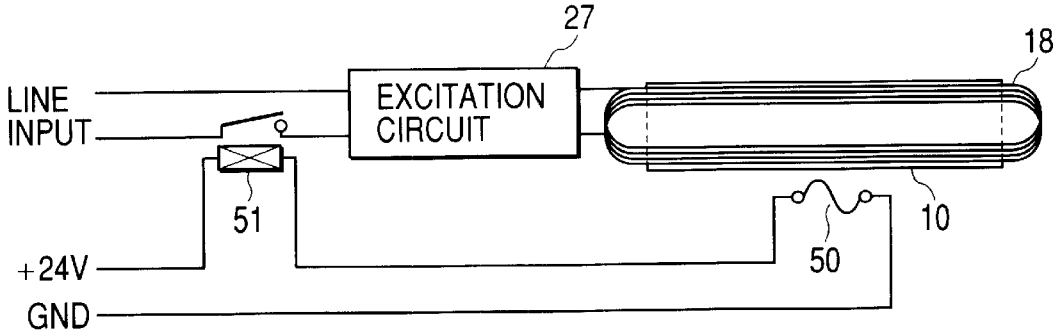
FIG. 7 is a view showing a safety circuit.

FIG. 7 is a circuit view showing a safety circuit used for the example. The thermoswitch 50 as the temperature detecting element is connected in series to a +24 VDC power source and a relay switch 51. When the thermoswitch 50 is turned OFF, supply of power to the relay switch 51 is cut off. When the relay switch 51 is operated, and supply of power to the excitation circuit 27 is cut off, supply of power to the exciting coil 18 is cut off. The thermoswitch 50 has an OFF operation temperature set equal to 220° C.

In addition, the thermoswitch 50 is disposed oppositely to the heat generating region H of the fixing belt 10 in non-contact with the outer surface of the fixing belt 10. A distance between the thermoswitch 50 and the fixing belt 10 is about 2 mm. Accordingly, no damage occurs in the fixing belt 10 because of no contact with the thermoswitch 50, making it possible to prevent degradation of the fixed image due to a durability problem.

According to the example, even when the heating apparatus stops while a sheet is stuck in the fixing nip portion N, and power is continuously supplied to the exciting coil 18 to continue heat generation in the fixing belt 10, the sheet is never directly heated because no heat is generated in the fixing nip portion N where the sheet is stuck. Moreover, since the thermoswitch 50 is disposed in the heat generating region H where a quantity of generated heat is large, the thermoswitch 50 detects 220° C. and, when the thermoswitch is turned OFF, supply of power to the exciting coil 18 by the relay switch 51 is cut off.

According to the example, no fire occurs in the sheet because an ignition temperature of the sheet is about 400° C., making it possible to prevent heat generation in the fixing belt 10.

Other than the thermoswitch, a thermal fuse can be used as a temperature detecting element.

(A) Exciting Coil 18

For the exciting coil 18, as conductors (electric wires) constituting a coil, a bundle of wires composed of a plurality of thin copper wires each insulated and coated is used, and this bundle of wires is wound by a plurality of times to form an exciting coil. In the described example, the exciting coil 18 is formed by winding such a bundle of wires by 10 turns.

For insulating and coating, use of a coat having heat resistance is recommended, considering heat conduction by heat generation in the fixing belt 10. For example, a coat of polyamide imide, polyimide or the like may be used.

For the exciting coil 18, its density may be increased by applying a pressure from an external device.

The exciting coil 18 is formed to have a shape along a curved surface of the heat generation layer as shown in FIG. 2 or FIG. 6. In the example, a distance between the heat generating layer of the fixing belt 10 and the exciting coil 18 is set roughly equal to 2 mm.

For the belt guiding member 16*a* serving also as an exciting coil holding member, use of a highly insulating and heat-resistant material is recommended. For example, one may be selected from a phenol resin, a fluororesin (PFA resin, PTFE rein, or FEP resin), a polyimide resin, a polyamide resin, a poly amide imide resin, a PEEK resin, a PES resin, an LCP resin, and the like.

Absorption efficiency of a magnetic flux is high when a distance between the magnetic cores 17*a* to 17*c* and the exciting coil 18, and the heat generating layer of the fixing belt 10 is set as small as possible. However, the distance should be set within 5 mm, because a considerable reduction occurs in efficiency if it exceeds 5 mm. Within 5 mm, it is not necessary to maintain constant the distance between the heat generating layer of the fixing belt 10 and the exciting coil 18.

For exciting coil leader lines 18*a* and 18*b* (FIG. 5) from the belt guiding member 16*a* holding the exciting coil 18, an insulating coat is applied on a portion out of the member 16*a* outside the bundle of wires.

(B) Fixing Belt 10

Figure 8:
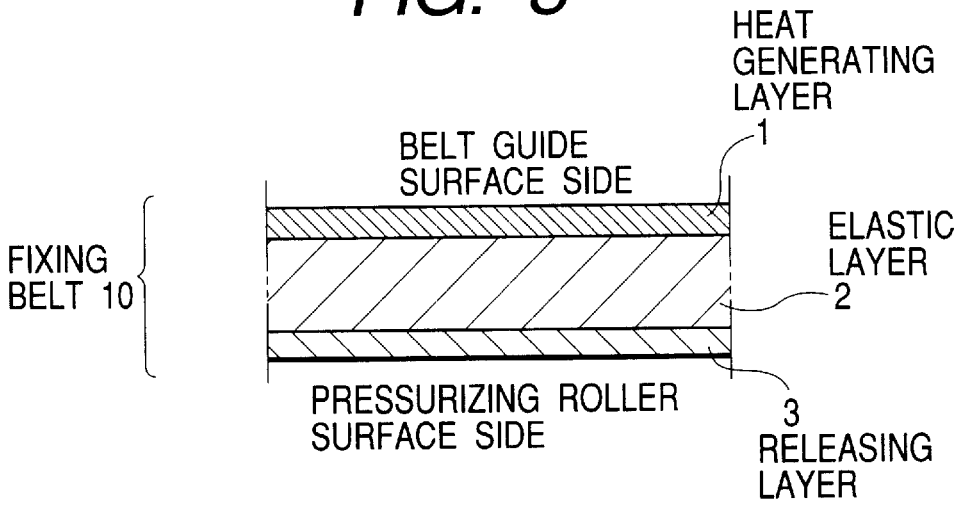
FIG. 8 is a view showing an example of a layer structure of a fixing belt.

FIG. 8 is a schematic view showing a layer structure of the fixing belt 10 in the described example. The fixing belt 10 of the example has a composite layer structure including a heat generating layer 1 made of a metal belt or the like, which has an electromagnetic induction heat generating property, and becomes a base payer of the fixing belt 10, an elastic layer 2 laminated on an outer surface thereof, and a releasing layer 3 laminated on an outer surface thereof. A primer layer (not shown) may be provided between layers for adhesion between the heat generating layer 1 and the elastic layer 2, or adhesion between the elastic layer 2 and the releasing layer 3. In the roughly cylindrical fixing belt 10, the heat generating layer 1 is set in the inner surface side; and the releasing layer 3 in the outer surface side. As described above, application of an alternating magnetic flux on the heat generating layer 1 generates an eddy current in the heat generating layer 1, thereby causing the heat generating layer 1 to generate heat. This heat heats the fixing belt 10 through the elastic layer 2/the releasing layer 3, and the recording material P as a material to be heated, which is fed to the fixing nip portion N, is heated, and then a toner image is heated and fixed.

a. Heat Generating Layer 1

For the heat generation layer 1, ferromagnetic metal such as nickel, iron, ferromagnetic SUS, or a nickel-cobalt alloy may be used.

Nonmagnetic metal may be used, but metal having high magnetic flux absorptive power such as nickel, iron, magnetic stainless steel, or a cobalt-nickel alloy is more preferable.

Preferably, a thickness of the heat generating layer 1 should be set larger than a depth of a surface represented by the following equation, and equal to 200 $\mu$m or lower. A surface depth $\sigma$[m] is represented as follows by using a frequency f [Hz] of the excitation circuit, magnetic permeability $\mu$, and intrinsic resistance $\rho$[$\Omega$m]:

$$\sigma=503\times(\rho/f\mu)^{1/2}$$

Figure 9:
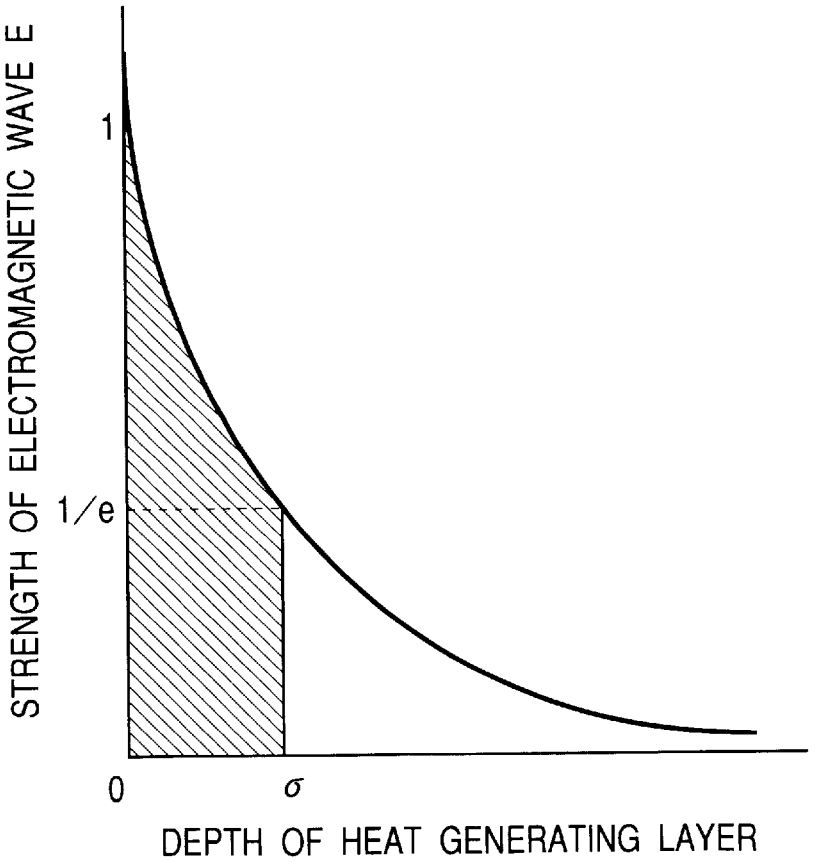
FIG. 9 is a graph showing a relation between a depth of a heat generating layer and a strength of an electromagnetic wave.

The equation specifically represents a depth of absorbing an electromagnetic wave used for electromagnetic induction. Deeper than this, a strength of the electromagnetic wave is 1/e or lower. In other words, most of energy is absorbed before this depth (FIG. 9).

A thickness of the heat generating layer 1 is preferably set in a range of 1 to 100 $\mu$m. If the thickness of the heat generating layer 1 is smaller than 1 $\mu$m, efficiency is reduced because most electromagnetic energy cannot be absorbed. If the thickness of the heat generating layer 1 exceeds 100 $\mu$m, rigidity becomes too high, and bendability is reduced, making it impractical to use it as a rotor. Thus, the thickness of the heat generating layer 1 should preferably be set in the range of 1 to 100 $\mu$m.

b. Elastic Layer 2

For the elastic layer 2, a heat-resistant and highly heat-conductive material such as silicon rubber, or fluorosilicon rubber is recommended.

A thickness of the elastic layer 2 is preferably set in a range of 10 to 500 $\mu$m. This thickness of the elastic layer is necessary to guarantee a fixed image quality. In the case of printing a color image, especially in a photographic image, a solid image is formed over a large area on the recording material P. In such a case, uneven heating occurs if a surface to be heated (releasing layer 3) cannot follow irregularity of the recording material or the toner layer, and gloss unevenness occurs between a portion of a large quantity of conducted heat and a portion of a small quantity of conducted heat. Glossiness is high in the portion of the large quantity of conducted heat; low in the portion of the small quantity of conducted heat. If the thickness of the elastic layer 2 is equal to 10 $\mu$m or lower, image gloss unevenness occurs because it cannot follow the irregularity of the recording material or the toner layer. If the thickness of the elastic layer 2 is equal to 100 $\mu$m or higher, heat resistance of the elastic layer becomes high, reducing a temperature response. More preferably, the thickness of the elastic layer 2 should be set in a range of 50 to 500 $\mu$m.

If hardness of the elastic layer 2 is too high, image gloss unevenness occurs because it cannot follow the irregularity of the recording material or the toner layer. Thus, the hardness of the elastic layer 2 should be set equal to 60° or lower (JIS-A: JIS K A type measuring apparatus is used), more preferably equal to 45° or lower.

Regarding heat conductivity λ of the elastic layer 2, a range of 0.25 to 0.84 [W/m·° C.] is recommended. If the heat conductivity X is smaller than 0.25 [W/m·° C.], heat resistance is high, slowing down a temperature increase in the surface layer (releasing layer 3) of the fixing belt. If the heat conductivity λ is larger than 0.84 [W/m·° C.], hardness becomes too high, or compressed permanent distortion is deteriorated. Thus, the heat conductivity λ should be set in the range of 0.25 to 0.84 [W/m·° C.], more preferably in a range of 0.33 to 0.63 [W/m·° C.].

c. Releasing Layer 3

For the releasing layer 3, a material having a high releasing property and high heat resistance can be selected, e.g., a fluororesin (PFA, PTFE, and FEP), a silicon resin, a fluorosilicon, fluorine-containing rubber or the like.

A thickness of the releasing layer 3 is preferably set in a range of 1 to 100 μm. If the thickness of the releasing layer 3 is smaller than 1 μm, problems including a portion of a bad releasing property, insufficient durability and the like occur because of uneven coating of a deposited film. If the thickness of the releasing layer 3 exceeds 100 μm, a problem of reduced heat conduction occurs, hardness becomes too high especially in the case of the resin-containing releasing layer, eliminating an advantage of the elastic layer 2.

Figure 10:
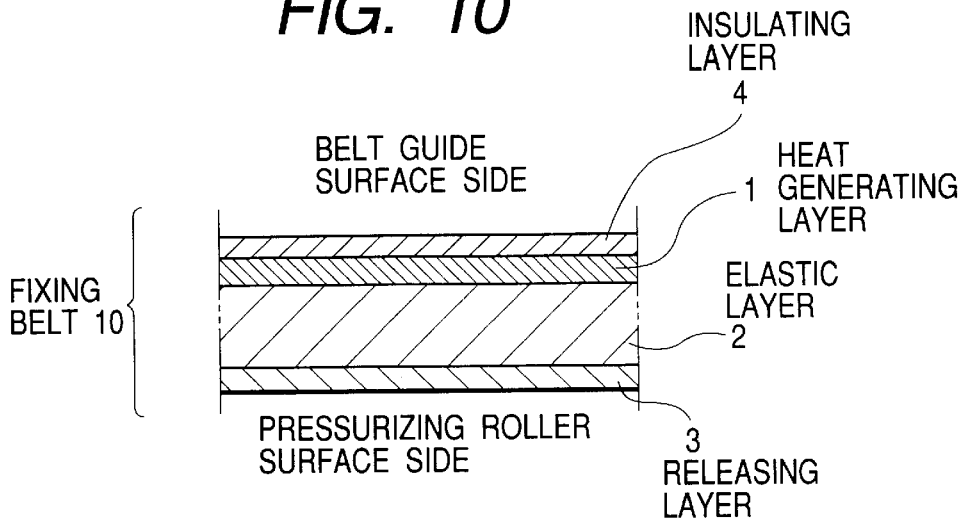
FIG. 10 is a view showing an example of a layer structure of a fixing belt.

In addition, as shown in FIG. 10, an insulating layer 4 may be provided in a belt guide surface side of the heat generating layer 1 (surface side opposite the elastic layer 2 of the heat generating layer 1).

For the insulating layer 4, a heat-resistant resin is recommended, e.g., a fluororesin (PFA resin, PTFE resin, and FEP resin), a polyimide resin, a polyamide resin, a polyamide imide resin, a PEEK resin, a PES resin, a PPS resin or the like.

A thickness of the insulating layer 4 is preferably set in a range of 10 to 1000 μm. If the thickness of the insulating layer 4 is smaller than 10 μm, an insulating advantage is not provided, and durability is insufficient. On the other hand, if the thickness exceeds 1000 μm, a distance between the magnetic cores 17*a* to 17*c* and the exciting coil 18, and the heat generating layer 1, becomes larger, making it impossible to sufficiently absorb a magnetic flux in the heat generating layer 1.

Since the insulating layer 4 can insulate inner side of the fixing belt from heat generated in the heat generating layer 1, compared with the case of no presence of the insulating layer 4, efficiency of supplying heat to the recording material P side can be increased. Thus, consumption of power can be reduced.

(C) Power Control

Figure 11:
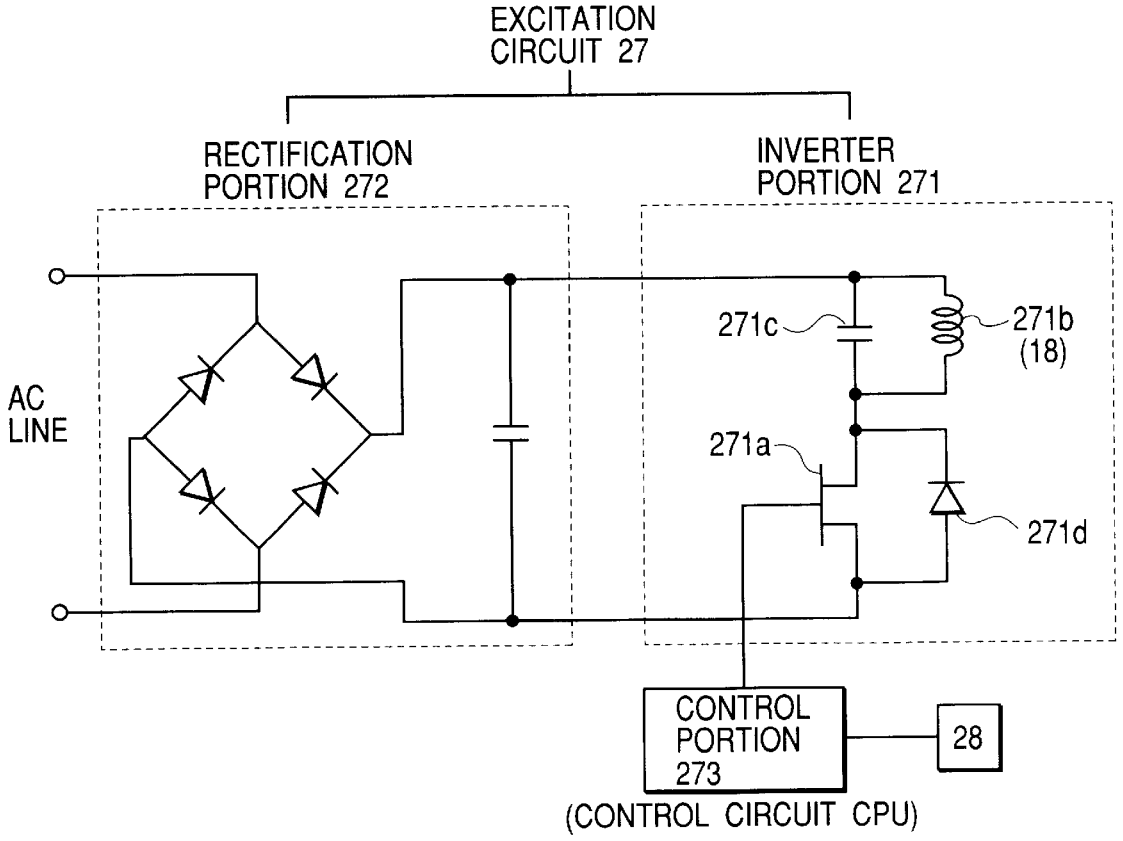
FIG. 11 is a view of an excitation circuit according to the first embodiment.

FIG. 11 is a circuit view showing the excitation circuit 27 as a power source for supplying power to the exciting coil 18.

A reference numeral 272 denotes a rectification portion composed of a double-wave rectification diode for rectifying an entered AC line voltage; 271 an inverter portion for generating a high-frequency voltage by a voltage resonance system; 271*a* a switching element such as an IGBT; 271*b* a resonance coil (exciting coil 18); 271*c* a resonance capacitor; 204*d* a regenerative diode; and 273 a control portion (control circuit CPU) for controlling an ON width of the switching element 271*a* based on information from the temperature detecting thermistor (temperature sensor) 28.

Figure 16A:
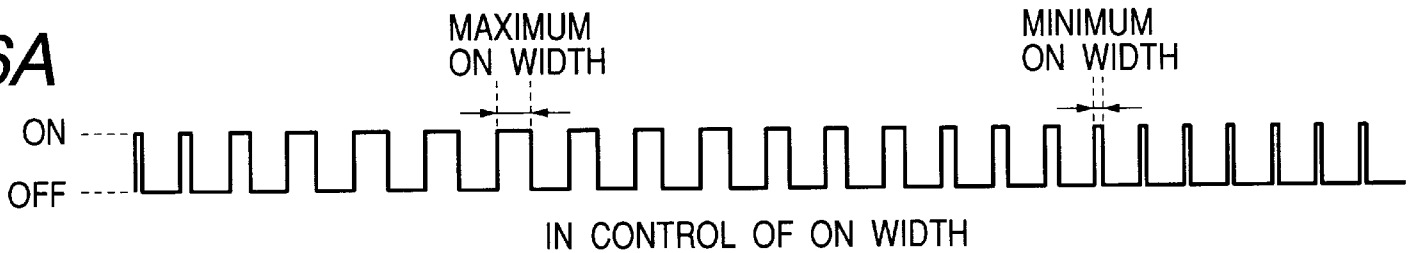
FIGS. 16A and 16B are views, each showing an operation waveform in the first embodiment.

As shown in FIG. 16A, in a normal state, a current flowing to the resonance coil 271*b* is made variable only by switching element ON width control of the inverter portion 271 and, by controlling power of its heat generation, temperature control of the fixing apparatus is executed.

Figure 16B:
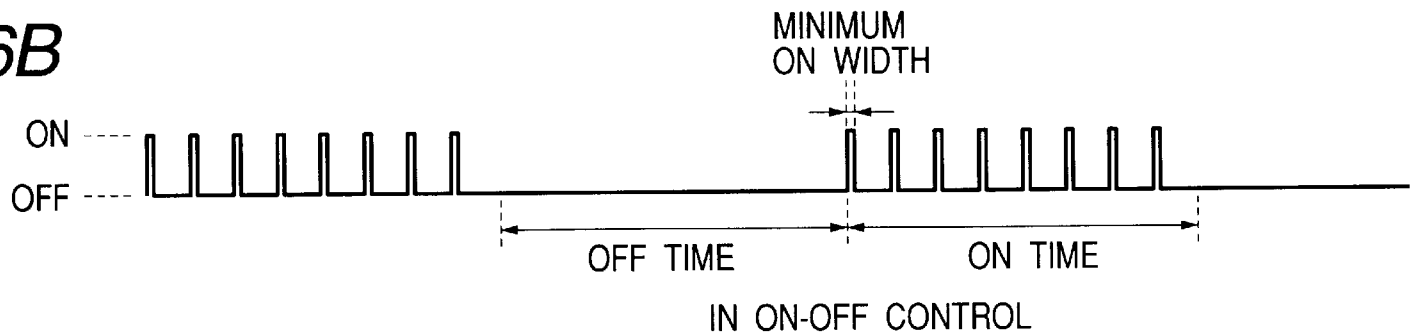

However, in the case of continuous printing where a temperature is increased irrespective of a minimum ON width of the switching element 271*a*, as shown in FIG. 16B, processing is switched to ON-OFF repetition control by fixing the ON width of the switching element 271*a* to the minimum ON width.

Here, ON time and OFF time in ON-OFF control mean that the switching element 271*a* is driven by an ON width for minimum power for predetermined ON time, and then the switching element is not driven at all for predetermined OFF time, which is much longer than the driving time of the switching element 271*a*.

Figure 17:
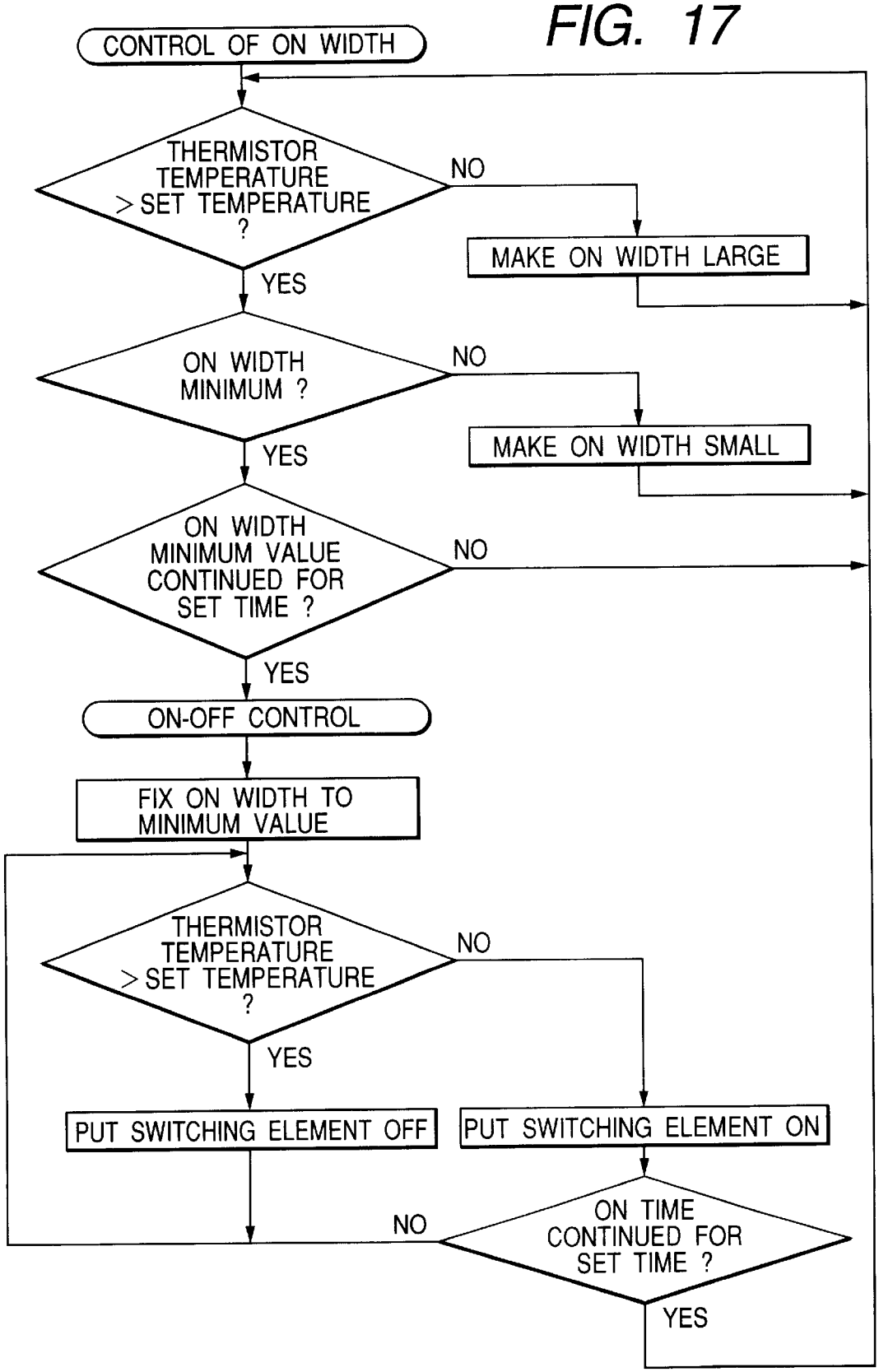
FIG. 17 is a flowchart showing an operation of the first embodiment.

FIG. 17 shows a flow of control. Normally, a temperature measured by the thermistor 28 is compared with a set temperature, and control is executed such that an ON width can be made large when the measured temperature is higher than the set temperature, and small when it is lower (in ON width control). However, if a minimum ON width state continues for a prescribed time or more, the process moves to ON-OFF control considering that the state of a high set temperature continues irrespective of the minimum ON width. In the ON-OFF control, control is executed in such a way as to set the switching element 271*a* itself OFF when the temperature is larger than the set temperature, and ON at the minimum ON width when it is lower. However, if the ON time of the switching element 271*a* continues for a prescribed time or more, the process returns to ON width control considering that a temperature increase cannot be expected at the minimum ON width.

When the OFF state of the switching element 271*a* is continued, a voltage applied to the switching element 271*a* becomes a power supply voltage level, and a current flows in a voltage applied state at ON time, resulting in a power loss. However, the ON time and the OFF time are set on orders of mS, which are much longer compared with an μS order of the switching element ON width.

Accordingly, generated heat can be sufficiently radiated by a heat sink.

In terms of input power, power required by the fixing apparatus is in the range of 1100 to 100 W, and control in a high power side of 1100 to 400 W is executed by the ON width control of the switching element 271*a*; and control in a low power side of 400 to 100 W by the ON-OFF control.

The foregoing control enables even the low power side not controlled by the switching element 271*a* of the inverter portion 271 to be controlled well.

Moreover, since the ON width control of the switching element 271*a* is maintained in the high power side, a switching loss can be reduced, making it possible to control high power without any losses.

(Second Embodiment)

Figure 12:
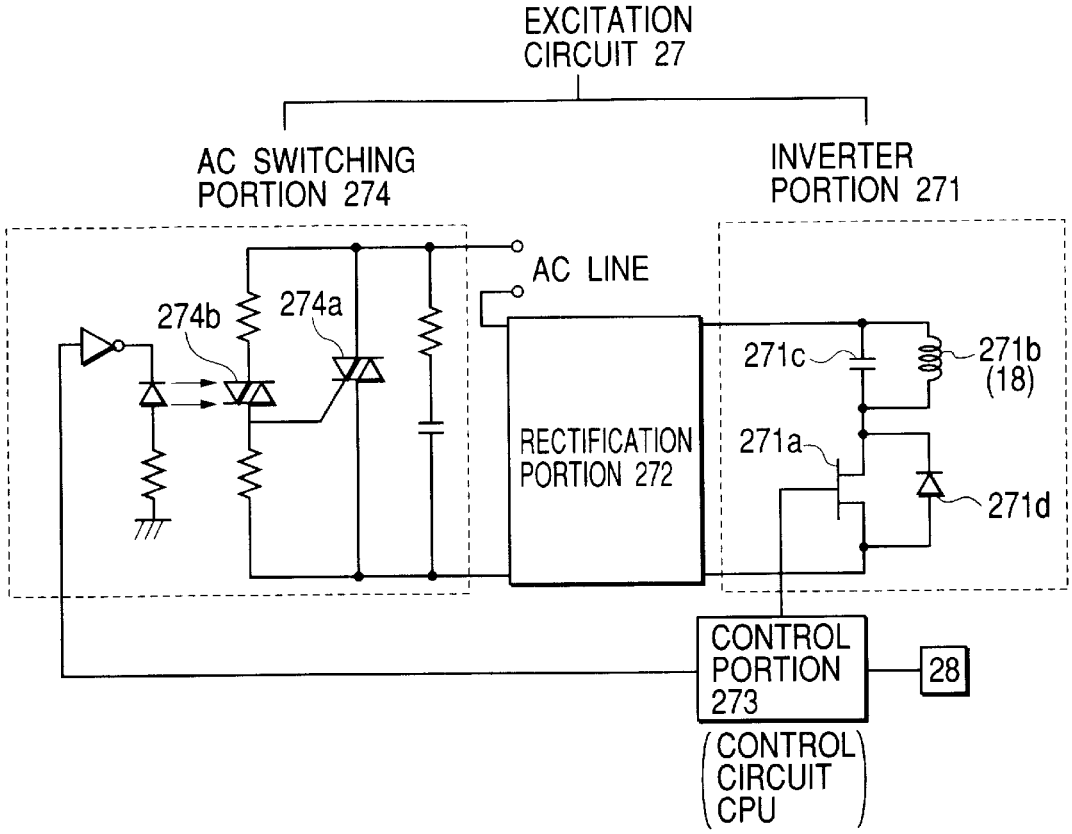
FIG. 12 is a view of an excitation circuit according to a second embodiment.
Figure 13:
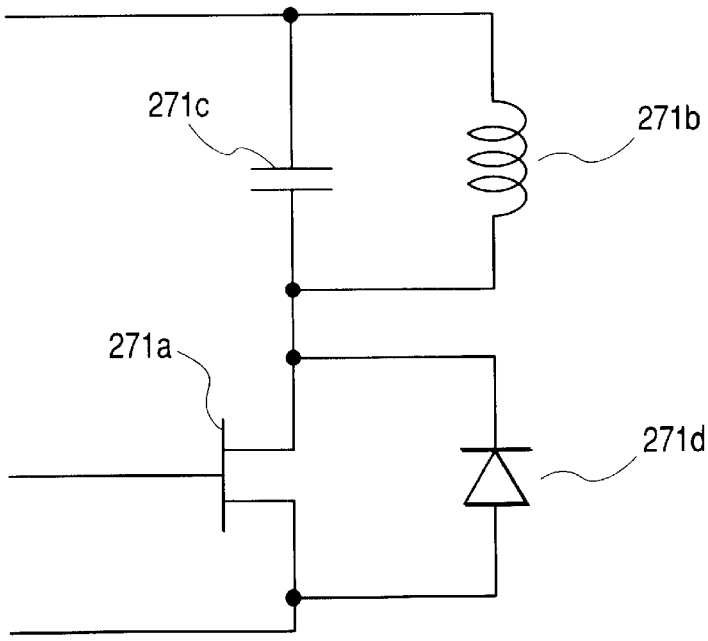
FIG. 13 is a view showing an inverter circuit of a voltage resonance system.
Figure 14:
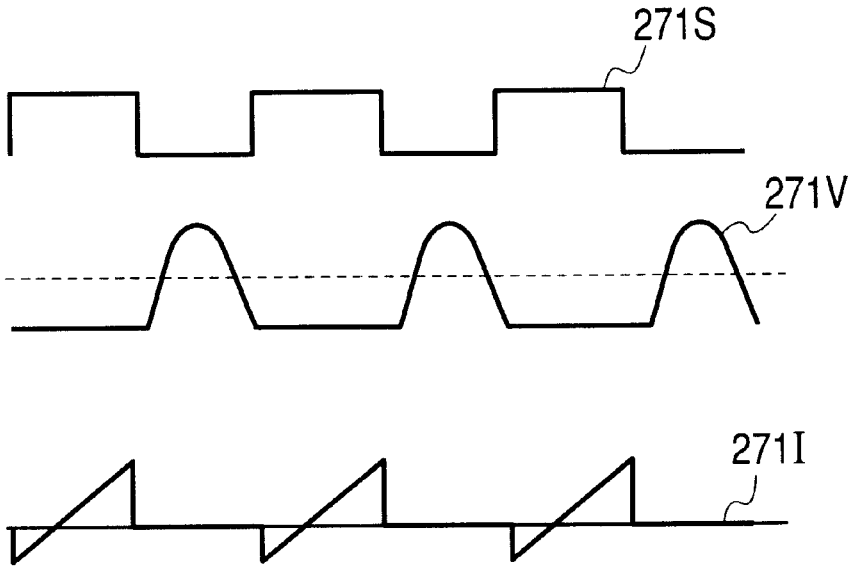
FIG. 14 is a view showing an operation waveform in the inverter circuit of the voltage resonance system.
Figure 15:
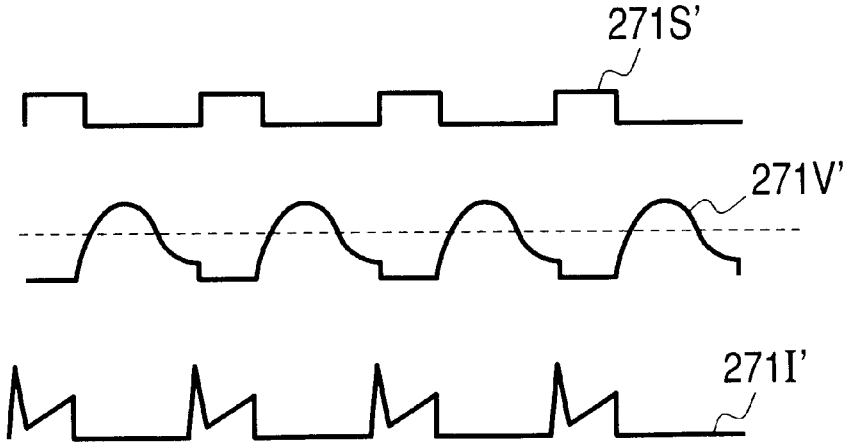
FIG. 15 is a view showing an operation waveform when a switching ON width in the inverter circuit of the voltage resonance system is small.

FIG. 12 is a circuit block diagram of an excitation circuit according to a second embodiment. Description of portions of the second embodiment similar to those of the excitation circuit 27 (FIG. 1) of the first embodiment will be omitted, and only portions as features of the embodiment will be described.

In the first embodiment, when the ON-OFF repetition control is executed by fixing the switching element 271*a* to the minimum ON width, a current always flows in the voltage applied state of the switching element 271*a* at the time of switching from OFF to ON, a power loss occurs though not a serious level.

In the ON-OFF control, the ON time and the OFF time may be shortened to execute smooth temperature control. In such a case, however, the problem of a power loss is highlighted as described above.

Therefore, according to the second embodiment, another switching means is prepared to execute ON-OFF control, and a load on a switching element 271*a* is reduced, thereby realizing smooth temperature control.

A reference numeral 274 denotes an AC switching portion for turning ON/OFF an AC voltage entered from an AC line by using a triac 274*a* and a phototriac 274*b*; 272 a rectification portion; 271 an inverter portion for controlling heat generating power by making variable an ON width of the switching element 271*a*, and controlling a current flowing to a resonance coil 271*b* (exciting coil 18); and 273 a control portion (control circuit CPU) for executing ON width control of the switching element 271*a*, and ON-OFF control of the triac 274*a* based on information from a temperature detecting thermistor 28.

Normally, with the triac 274*a* always set in an ON state, temperature control is executed only by switching element ON width control of the inverter portion.

However, if a temperature is increased irrespective of a minimum ON width of the switching element 271*a*, ON-OFF control of the triac 274*a* is executed by fixing the ON width of the switching element 271*a* to the minimum ON width.

In terms of input power, power required by the fixing apparatus is in the range of 1100 to 100 W, and control in a high power side of 1100 to 400 W is executed by the ON width control of the switching element 271*a*; and control in a low power side of 400 to 100 W by the ON-OFF control.

The foregoing control enables even the low power side not controlled by the switching element 271*a* of the inverter portion to be controlled well.

Moreover, since the ON width control of the switching element 271*a* is maintained in the high power side, a switching loss can be reduced, making it possible to control high power without any losses.

The ON-OFF control in the switching element 271*a* enables smooth temperature control to be realized.

The embodiment has been described by way of example of the On-OFF control using the triac 274*a*. However, ON-OFF control may be executed in another switching element, or by using an AC—AC converter.

Instead of switching the AC voltage of the line, a DC voltage rectified by the rectification portion can be controlled by a DC—DC converter or the like.

Furthermore, as the inverter circuit of the resonance system, the general inverter circuit of the voltage resonance system was described. Needless to say, however, the present invention can be applied to inverter circuits of other types.

(Other Embodiments)

(1) In the foregoing embodiment, since the toner containing a low softening material is used, no oil coating mechanisms are provided in the heating apparatus 100 to prevent offsets. However, when toner containing no low softening materials is used, an oil coating mechanism may be provided.

(2) Cooling separation may be performed by providing a cooling portion after the fixing nip portion. Oil coating or cooling separation may also be performed when toner containing a low softening material is used.

(3) The image forming apparatus has been described by way of example of the 4-color image forming apparatus comprising one photosensitive body. However, a 4-color image forming apparatus comprising four photosensitive bodies may be used.

The 4-color image forming apparatus has been described. However, in case of monochromatic one path multicolor image forming apparatus, the fixing belt can be constituted only by the heat generating layer 1 and the releasing layer 3 while the elastic layer 2 is omitted.

(4) The heating apparatus of the present invention is not only used as the image heating and fixing apparatus of the embodiment, but can be widely used as, e.g., an image heating apparatus for improving a surface quality such as gloss by heating a recording material bearing an image, an image heating apparatus for temporarily fixing an image by heating a recording material bearing the image, a heating apparatus for feeding a sheet-like object, and subjecting it to drying/laminating/wrinkle removing by hot pressing, and the like.

(5) Needless to say, a configuration of the heating apparatus is not limited to those of the embodiments. For example, an apparatus may have a configuration where a heating member (conductive member) having a magnetic induction heat generating property is disposed in a fixed manner, this heating member is caused to generate heat in a magnetic inductive manner in a magnetic field generated by magnetic field generating means, and a target material is heated directly by the heating member, or through a heat conductive member such as a heat-resistant belt or the like.

As apparent from the foregoing, according to the present invention, in the heating apparatus of the magnetic induction heating system, in a normal state, power is controlled by the ON width control of the switching element of the inverter circuit and, to control power of the minimum ON width or lower, low to high power can be controlled by fixing the ON width of the switching element to the minimum ON width, and executing ON-OFF repletion control. As a result, it is possible to perform continuous printing satisfactorily even when the magnetic induction heating system is employed for the heating apparatus of the image forming apparatus.

What is claimed is:

1. A heating apparatus of a magnetic induction heating system comprising:

magnetic field generating means for generating a magnetic field;

a power source circuit for supplying power to said magnetic field generating means, said power source circuit having a switching element; and control means for controlling the power supplied to said magnetic field generating means, said control means having means for controlling turning ON-OFF of the switching element, wherein said control means includes a first mode for controlling the power supplied to said magnetic field generating means by controlling an ON width of the switching element to be variable, and a second mode for controlling the power supplied to said magnetic field generating means by fixing the ON width of the switching element to a predetermined ON width.

2. A heating apparatus according to claim 1, wherein the predetermined ON width is equal to a minimum ON width in the first mode.

3. A heating apparatus according to claim 1, wherein said control means controls the power supplied to said magnetic field generating means on the first mode when power larger than a predetermined value is supplied, and controls the power supplied to said magnetic field generating means in the second mode when power smaller than the predetermined value is supplied.

4. A heating apparatus according to claim 1, wherein said control means controls the power supplied to said magnetic field generating means by fixing the ON width of the switching element to the predetermined ON width, and controlling number of ON times of the switching element per unit time to be variable, in the second mode.

5. A heating apparatus according to claim 1, wherein said power source circuit includes a rectification portion for rectifying an alternating current.

6. A heating apparatus according to claim 5, wherein said power source circuit includes a resonance capacitor connected in parallel to said magnetic field generating means, the switching element is connected in series to a parallel circuit composed of said magnetic field generating means and the resonance capacitor, and the power is supplied to said magnetic field generating means by using a rectified output from the rectification portion based on a voltage resonance system.

7. A heating apparatus according to claim 5, further comprising switching means for turning ON-OFF of application of an alternating current to the rectification portion, wherein said control means includes means for controlling turning ON-OFF of said switching means in the second mode.

8. An image forming apparatus comprising:

image forming means for forming and bearing an unfixed toner image on a recording material; and fixing means for fixing the unfixed toner image on the recording material by heat, wherein said fixing means including:

magnetic field generating means for generating a magnetic field;

a power source circuit for supplying power to the magnetic field generating means, the power source circuit having a switching element; and control means for controlling the power supplied to the magnetic field generating means, wherein the control means has means for controlling turning ON-OFF of the switching element, and wherein the control means has a first mode for controlling the power supplied to the magnetic field generating means by controlling an ON width of the switching element to be variable, and a second mode for controlling the power supplied to the magnetic field generating means by fixing the ON width of the switching element to a predetermined ON width.

9. An image forming apparatus according to claim 8, wherein the predetermined ON width is equal to a minimum ON width in the first mode.

10. An image forming apparatus according to claim 8, wherein the control means controls the power supplied to the magnetic field generating means on the first mode when power larger than a predetermined value is supplied, and controls the power supplied to the magnetic field generating means in the second mode when power smaller than the predetermined value is supplied.

11. An image forming apparatus according to claim 8, wherein the control means controls the power supplied to the magnetic field generating means by fixing the ON width of the switching element to the predetermined ON width, and controlling number of ON times of the switching element per unit time to be variable, in the second mode.

12. An image forming apparatus according to claim 8, wherein the power source circuit has a rectification portion for rectifying an alternating current.

13. An image forming apparatus according to claim 12, wherein the power source circuit has a resonance capacitor connected in parallel to the magnetic field generating means, the switching element is connected in series to a parallel circuit composed of the magnetic field generating means and the resonance capacitor, and the power is supplied to the magnetic field generating means by using a rectified output from the rectification portion based on a voltage resonance system.

14. An image forming apparatus according to claim 12, further comprising switching means for turning ON-OFF of application of an alternating current to the rectification portion, wherein the control means has means for controlling turning ON-OFF of the switching means in the second mode.

15. An image forming apparatus according to claim 8, further comprising a temperature sensor for detecting a temperature of said fixing means, wherein the control means controls the power supplied to the magnetic field generating means based on an output from said temperature sensor.

16. A method for controlling power supplied to magnetic field generating means for generating a magnetic field, comprising steps of:

deciding power to be supplied to the magnetic field generating means; and based on the decided output, determining which of a plurality of modes is used to perform power control, the plurality of modes including a first mode for controlling the power supplied to the magnetic field generating means by controlling an ON width of a switching element of a power source circuit for supplying the power to the magnetic field generating means to be variable, and a second mode for controlling the power supplied to the magnetic field generating means by fixing the ON width of the switching element to a predetermined ON width.

17. A method according to claim 16, wherein the predetermined ON width is equal to a minimum ON width in a first control step.

18. A method according to claim 16, wherein in said determination step, the power supplied to the magnetic field generating means is determined to be controlled in the first mode when power larger than a predetermined value is supplied, and in the second mode when power smaller than the predetermined value is supplied.

19. A method according to claim 16, wherein on the second mode, the power supplied to the magnetic field generating means is controlled by fixing the ON width of the switching element to the predetermined ON width, and controlling number of ON times of the switching element per unit time to be variable.

20. A method according to claim 16, wherein the power source circuit includes a rectification portion for rectifying an alternating current and, in the second mode, the power supplied to the magnetic field generating means is controlled by fixing the ON width of the switching element to the predetermined ON width, and controlling turning ON-OFF of application of an alternating current to the rectification portion by using switching means.

* * * * *

UNITED STATES PATENT AND TRADEMARK OFFICE

CERTIFICATE OF CORRECTION

PATENT NO. : 6,608,289 B2
DATED : August 19, 2003
INVENTOR(S) : Takaaki Tsuruya

It is certified that error appears in the above-identified patent and that said Letters Patent is hereby corrected as shown below:

Column 14,
Line 59, “on” should read -- in --.

Column 15,
Line 49, “on” should read -- in --.

Signed and Sealed this

Sixth Day of January, 2004

JAMES E. ROGAN
*Director of the United States Patent and Trademark Office*